United States Patent [19]

Okuda

[11] 4,206,717

[45] Jun. 10, 1980

[54] MOORING APPARATUS

[75] Inventor: Hiroji Okuda, Nara, Japan

[73] Assignee: Koyo Seiko Company Limited, Osaka, Japan

[21] Appl. No.: 933,131

[22] Filed: Aug. 9, 1978

[30] Foreign Application Priority Data

Apr. 27, 1978 [JP] Japan ..... 53-51429

[51] Int. Cl.[2] ..... B63B 21/00

[52] U.S. Cl. ..... 114/230

[58] Field of Search ..... 114/230, 249, 250, 267; 14/27

[56] References Cited

U.S. PATENT DOCUMENTS

| | | | |
|---|---|---|---|
| 3,177,838 | 4/1965 | Grimes | 114/230 |
| 3,683,839 | 8/1972 | Harbisch | 114/249 |

FOREIGN PATENT DOCUMENTS

| | | | |
|---|---|---|---|
| 489872 | 3/1919 | France | 114/230 |
| 489444 | 7/1938 | United Kingdom | 114/267 |

*Primary Examiner*—Trygve M. Blix
*Assistant Examiner*—Jesus D. Sotelo
*Attorney, Agent, or Firm*—Mason, Fenwick & Lawrence

[57] ABSTRACT

An apparatus to be attached to each of at least two portions of a structure for mooring the structure to a pier comprises two universal joint assemblies to be arranged along two sides of a triangle having a base in parallel to the structure. Each of the joint assemblies includes a telescopic shank composed of two tubular members slidable one within the other, two universal joints provided at the opposite ends of the shank respectively, and superposed dish springs disposed within the shank to bias the tubular members away from each other.

4 Claims, 9 Drawing Figures

MOORING APPARATUS

BACKGROUND OF THE INVENTION

This invention relates to an apparatus for mooring heavy structures, such as a tank floating on the sea, to a pier, quay or the like.

As shown in FIG. 1, a structure such as a tank floating in a body of water is moored to a pier 2 by mooring means 3 positioned at two locations. Due to the presence of waves and wind, the moored structure 1 is usually subjected to a great force acting in a lateral direction, toward or away from the pier, or upward or downward as indicated at x, y or z in the drawing, or in a combined direction. In view of the volume and weight of the moored structure, the mooring means are therefore subjected to a very great force.

For use with such a large structure, only a few mooring apparatus are known. An apparatus as shown in FIG. 2 appears usable. A triangular truss 4 having a base in parallel to the structure 1 to be moored is connected thereto by two bearings 5. A shaft 7 provided with a damper 6 comprising a rubber member or a superposed assembly of dish springs is supported on a pier 2 and is slidable toward or away from the structure 1 (direction y) within a limited range d. The top of the truss 4 is connected to the outer end of the shaft 7 as by a universal joint 8.

Since at least two such mooring apparatus must be used for the structure 1, a force acting on the structure 1 toward or away from the pier 2 (direction y) or upward or downward (direction z) can be deflected and absorbed by the action of the damper, bearings and universal joint, but a force acting in a lateral direction (direction x) or in a combined direction of x, y and z (e.g. oblique direction) will subject the shaft 7 of the damper 6 to a high bending force. Accordingly special expediencies must be provided for the bearings 5 and the damper to give desired strength and action. Furthermore since it is desirable to hold the structure at least ten meters away from the pier or quay with use of the mooring apparatus, the shaft 7 would be subjected to an increasing bending force with the increase in the spacing, while increasing difficulties would then be encountered in attaching the mooring apparatus to the structure.

SUMMARY OF THE INVENTION

An object of this invention is to provide an apparatus for mooring a structure to a quay or pier while effectively absorbing the displacement of the structure toward or away from the pier, in a lateral, upward or downward direction, or in a combined direction.

Another object of this invention is to provide a mooring apparatus which is easily attachable to the structure to be moored and to the pier.

The mooring apparatus of this invention is used at each of at least two locations between a pier or quay and the structure to be moored thereto, such as a tank floating in a body of water, as seen in FIG. 1. The apparatus comprises two universal joint assemblies which are arranged along the two sides of a substantially equilateral triangle whose base is in parallel to the structure to be moored. Each of the universal joint assemblies comprises a telescopic shank and two universal joints provided at both ends of the shank respectively. One of the universal joints is connected to the structure, and the other joint is connected to a specified portion of the pier.

Accordingly the universal joints act for the upward or downward displacement (in direction z) of the structure, while the shanks telescopically expand or collapse to accommodate the displacement of the structure toward or away from the pier (direction y) or in a lateral direction (direction x). Especially the two mooring apparatus, by virtue of the expansion or contraction of their universal joint assemblies, permit the displacement of the structure in a lateral direction (direction x). Consequently no bending force will act on the universal joint assemblies at the top of the triangle on the pier, while the joints on the structure at the base are rendered free of any thrust force.

The shank of each of the universal joint assemblies comprises two tubular members one slidable within another and elastic means supported on suitable means within the shank and biasing the tubular members away from each other against collapsing, whereby the maximum and minimum spacings between the structure and pier are regulated. The elastic means further act to absorb the displacement of the structure toward or away from the pier or in a lateral direction.

Thus the elastic means produces an effective damping action on the displacement of the moored structure to prevent damage to the mooring apparatus. The elastic means comprises a number of superposed dish springs which impart an appropriate preload pressure on the joint assembly, affording a still improved damping effect.

Because the mooring apparatus of this invention comprises two universal joint assemblies, it is extremely simple in construction and easily attachable to the structure to be moored.

DESCRIPTION OF THE PREFERRED EMBODIMENT

Figure 1:
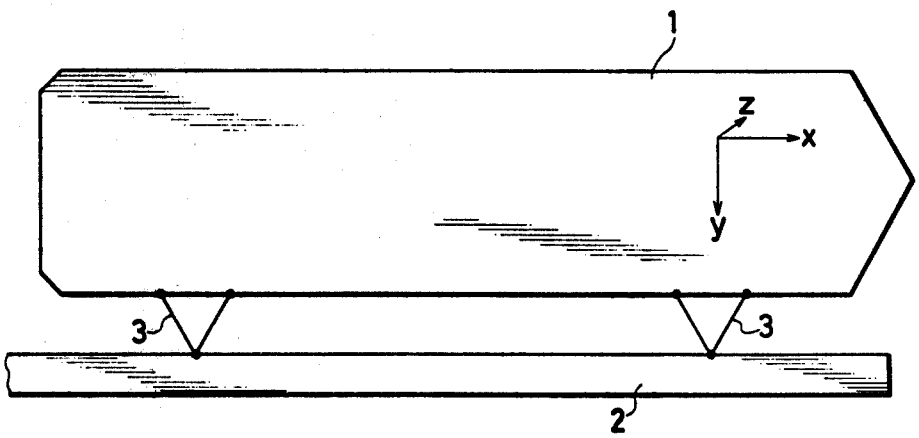
FIG. 1 is a plan view showing a structure moored to a pier.
Figure 2:
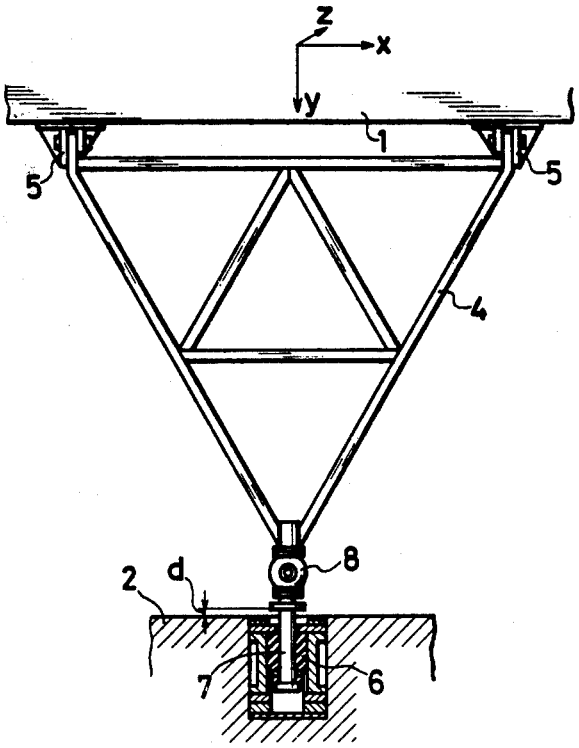
FIG.2 PRIOR ART
FIG. 2 is a plan view showing a mooring apparatus which appears usually usable.
Figure 3:
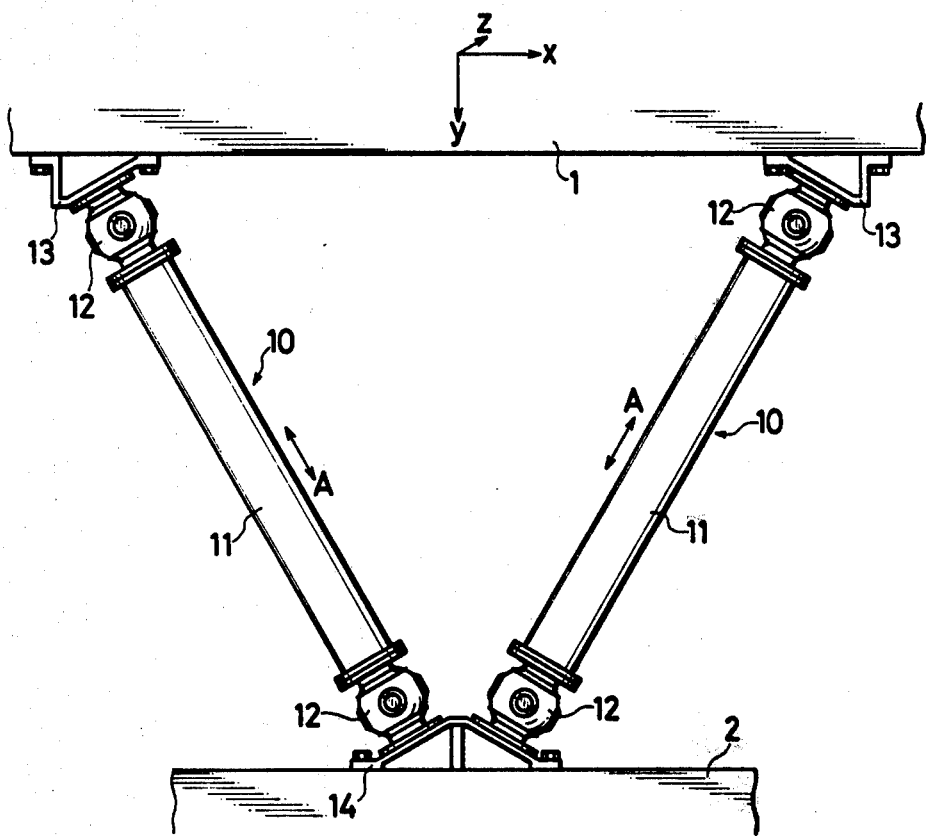
FIG. 3 is a plan view showing an embodiment of this invention.

FIG. 3 is a plan view showing a mooring apparatus embodying this invention and provided between a structure 1 floating in a body of water and a pier 2. The apparatus comprises two universal joint assemblies 10 arranged along the two sides of a substantially equilateral triangle having a base in parallel to the structure 1. As will be described below in greater detail, each of the assemblies 10 comprises a telescopic shank 11 and two universal joints 12 connected to the opposite ends of the shank 11 respectively. One of the universal joints 12 is connected to a mounting 13 on the structure 1, and the other joint 12 to a mounting 14 on the pier 2.

Accordingly the shanks 11 telescopically expand or collapse as indicated by the arrows A to accommodate the displacement of the structure 1 toward or away from the pier (direction Y), while the universal joints 12 act to accommodate the displacement of the structure 1 in an upward or downward direction (direction z). Thus the universal joint assemblies 10 permit the displacement of the moored structure in the directions x, y and z and also in the combination of these directions, assuring safety even when the structure is subjected to a great force. Additionally the sliding mechanism incorporated in each universal joint assembly as will be described below allows a sufficiently large displacement of the moored structure. Moreover, the mooring apparatus composed of two assemblies is compact and easy to attach or replace.

Figure 4:
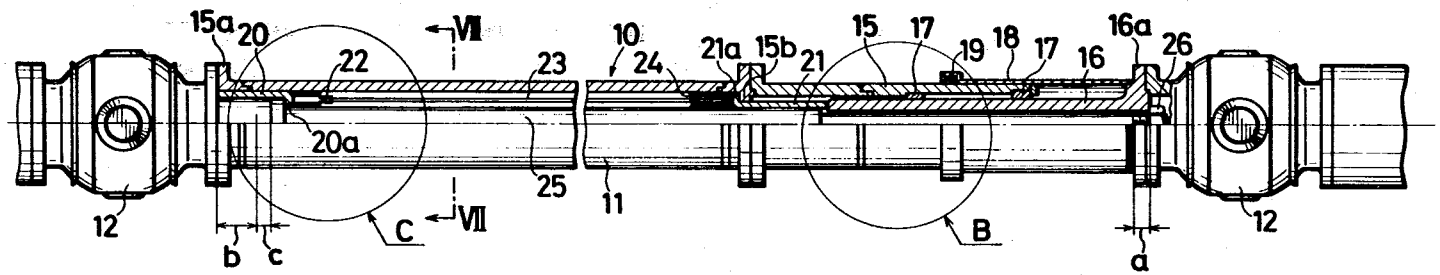
FIG. 4 is a view partly in vertical section and showing a universal joint assembly.
Figure 7:
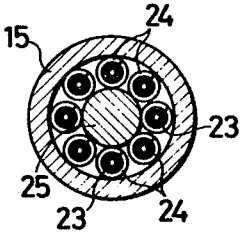
FIG. 7 is a view in cross section taken along the line VII—VII in FIG. 4.

The universal joint assembly 10 is shown in FIG. 4 et seq. The shank 11 of the assembly 10 comprises an outer pipe 15 and an inner pipe 16 axially slidably fitting in the pipe 15. Two sleeves 17 fitting in the outer pipe 15 guide the inner pipe 16 for sliding movement. A cover 18 covering and fitting around one end of the outer pipe 15 is secured at its base end to a flange 16*a* on the inner pipe 16. A seal member 19 secured to the inner periphery of the other end of the cover 18 is in sliding contact with the outer periphery of the outer pipe 15 to seal the space between the pipe 15 and the cover 18 and protect the interior of the cover 18 from water. The outer pipe 15, although composed of two pipe segments in the illustrated embodiment, may of course comprise a single piece or several segments which are joined together.

The outer pipe 15 has at its base end a flange portion 15*a* having a spring seat 20 slidably fitting therein and an inwardly projecting intermediate flange 15*b*. Another spring seat 21 slidable in the outer pipe 15 has a flanged end 21*a* in engagement with the intermediate flange 15*b* and the other end in abutting contact with the end of the inner pipe 16. Extending between the two spring seats 20 and 21 are a plurality of telescopic support rods as arranged circumferentially along the inner periphery of the outer pipe 15 at equal spacing. Each of the support rods comprises two hollow rods 22 and 23 one slidable within the other and supports thereon a number of superposed dish springs 24. The springs 24 exert their force axially on the shank 11 through the spring seats 20 and 21.

Figure 6:
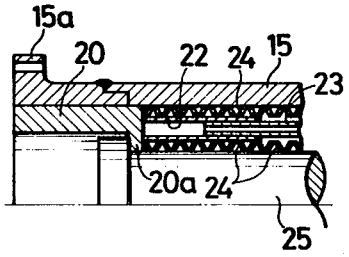
FIGS. 5 and 6 are enlarged views showing the portions B and C of FIG. 4 respectively.
Figure 5:
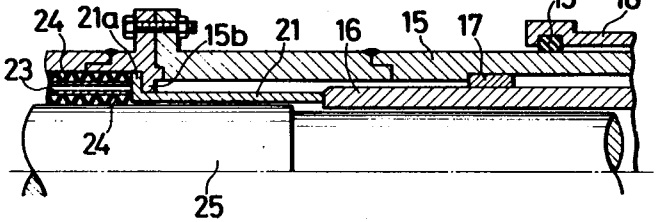

The spring seat 20 fitting in the flange portion 15*a* of the outer pipe 15 has an inwardly projecting flange 20*a*. A bolt 25 extending centrally through the pipes 15 and 16 has a head bearing against the flange 20*a*. A nut 26 seated on the end face of the flange 16*a* of the inner pipe 16 is screwed on the bolt 25. The nut 26, when tightened up, gives an appropriate preload pressure to the elastic means comprising the dish springs. The support rods composed of the hollow rods 22 and 23, when sealed at their opposite ends with the spring seats 20 and 21 and filled with a suitable gas or liquid, will absorb the impact to be delivered onto the shank 11 to collapse, the shank 11, by virtue of the compression of the fluid (see FIG. 6.) Alternatively one of the hollow rods may be provided with an orifice for regulating the flow of the fluid, such that an impactive load or static load, when occurring, will cause the fluid in the other hollow rod to flow into the former hollow rod through the orifice. This shock absorbing arrangement of the usual construction is of course useful.

Figure 9:
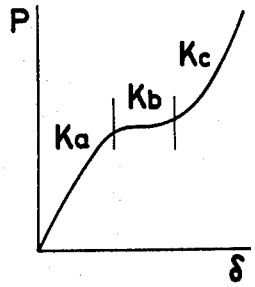
FIG. 9 is a diagram illustrating the spring constant of elastic means.

The plurality of support rods each carrying superposed dish springs 24 as arranged to alternately face opposite directions are circumferentially equidistantly spaced on the inner periphery of the outer pipe 15 as already described. When the nut 26 is tightened up on the bolt 25 extending centrally through the arrangement of the spring means, preload pressure is griven to the spring means through the spring seats 20 and 21 and inner pipe 16. The spring means is designed to have a spring constant which is variable along the curve shown in FIG. 9 involving three ranges of Ka, Kb and Kc. In FIG. 9, the load P is plotted as ordinate vs., the displacement $\delta$ as abscissa.

Ka is the range in which a predetermined preload pressure can be given when the nut 26 is advanced or tightened up on the bolt 25. Kb is the range which is determined in view of great forces as of earthquake or typhoon which are likely to be exerted and the resulting displacement of the universal joint then expected. Kc is a higher range of spring constant values which will render the mooring joint portions free of abnormal impact or load to avoid impactive collision of the slidable portion, even when a force should be exerted which is greater than can be accommodated with the constant range corresponding to the sliding range b (FIG. 4). Assuming that the required preload pressure on the universal joint assembly is Fo, the force acting on the assembly is F, the maximum force on the assembly is Fmax, allowable sliding amount of the assembly is b+c (see FIG. 4) and the amount the nut can be tightened up or advanced is a, Ka, Kb and Kc are so determined as to have the following relations.

$$Ka = F/a.$$

$$Kb = F/b,\ Fo < F.$$

$$Kb \cdot b < Fmax < Fc \cdot c.$$

Thus the mooring apparatus of this invention can hold the moored structure to the pier or the like rigidly free of substantial displacement while the force acting thereon is not greater than the preload pressure on the dish springs. When the apparatus is subjected to a force exceeding the preload pressure as by the influence of typhoon, the elastic means such as dish springs permits the displacement of the structure while absorbing the force acting on the apparatus to hold the moored structure with safety. The apparatus is therefore operable without any damage or break.

Figure 8:
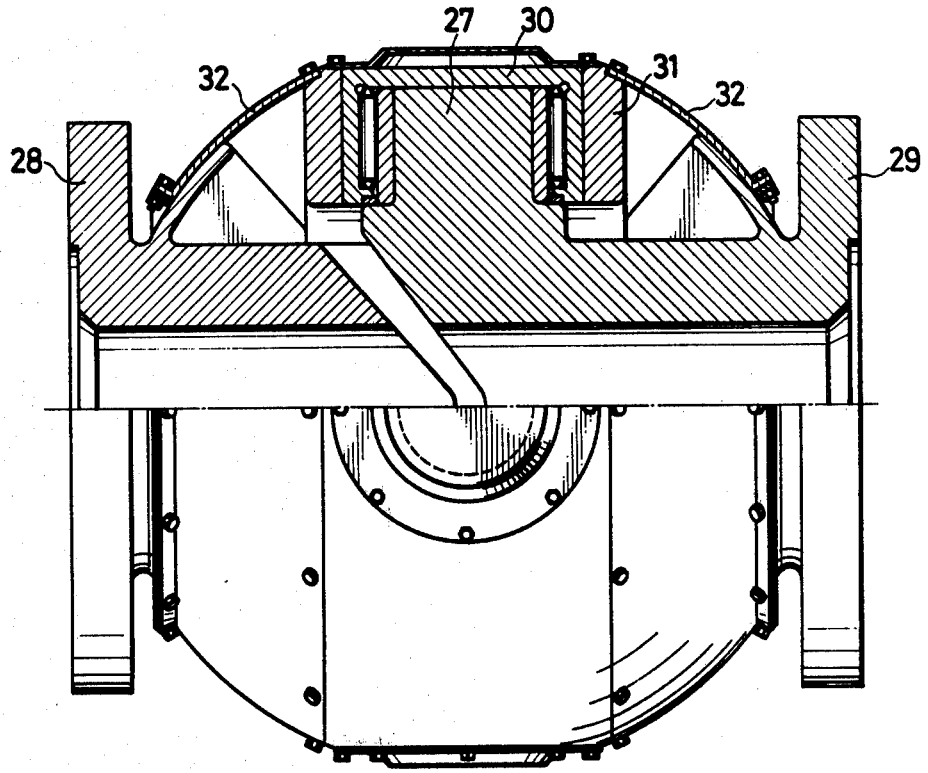
FIG. 8 is a view partly in vertical section and showing a universal joint.

As shown in FIG. 8 for illustrative purposes, the universal joint 12 comprises a pair of flange yokes 28 and 29 each formed with symmetrical trunnions 27 in diametrically opposed relation, needle bearings 30 fitting around the trunnions 27, annular members 31 fitting to and supporting the needle caps of the bearings 30, and spherical covers 32 secured to the annular members 31 and in sliding contact with spherical portions on the flange yokes 28 and 29 with seal members (not shown) provided therebetween. One of the flange yokes is secured as by bolts to the end flange of the shank 11, and the other flange yoke to the specified portion of the structure to be moored or of the pier.

The mooring apparatus, which comprises only two universal joint assemblies, is easy to install or replace and can be adapted for an increased amount of allowable displacement. Since the apparatus can be supported on the pier with two universal joints, compact universal joints are usable. The present apparatus is therefore advantageous in cost and appearance.

What is claimed is:

1. A mooring apparatus for use at each of at least two locations for mooring a floating structure to a pier, the mooring apparatus comprising two universal joint assemblies arranged along two sides of a triangle having a base in parallel to the floating structure, each of the universal joint assemblies including an axially telescopic shank with a universal joint at each end of the shank with one universal joint of each shank being connected to the pier and the other being connected to the floating structure, each of said shanks comprising two tubular members one of which is slidable within the other axially of the shank and a plurality of elastic means provided circumferentially within the shank for exerting telescopic force to bias the tubular members away from each other during axial expansion or contraction of the shank.

2. A mooring apparatus as defined in claim 1 wherein the elastic means includes two spring seat members each provided on one of the tubular members respectively and a plurality of superposed dish springs supported between the spring seat members to bias the spring seat members away from each other.

3. A mooring apparatus as defined in claim 1 wherein the universal joints connected to the pier are connected to a mounting on the pier defining the apex of the two sides of said triangle and the universal joints connected to the floating structure are connected to first and second spaced mountings respectively positioned on the floating structure at each end of the base of said triangle.

4. A mooring apparatus as defined in claim 3 wherein the elastic means includes two spring seat members each provided on one of the tubular members respectively and a plurality of superposed dish springs supported between the spring seat members to bias the spring seat members away from each other.

* * * * *